US005752821A

United States Patent [19]

Jo

[11] Patent Number: 5,752,821

[45] Date of Patent: May 19, 1998

[54] TRAY FOR HEAT TREATMENT FURNACE

[75] Inventor: In-ho Jo, Kyounggi-do, Rep. of Korea

[73] Assignee: Kia Motors Corporation, Seoul, Rep. of Korea

[21] Appl. No.: 674,388

[22] Filed: Jul. 2, 1996

[51] Int. Cl.[6] ..... C21D 9/00

[52] U.S. Cl. ..... 432/261; 432/258; 432/259; 269/54.5

[58] Field of Search ..... 482/258, 259, 482/261; 264/57, 58, 59; 269/43, 47, 52, 54.5, 309

[56] References Cited

U.S. PATENT DOCUMENTS

| | | | |
|---|---|---|---|
| 3,953,014 | 4/1976 | Mendell, Jr. | 269/43 |
| 4,184,840 | 1/1980 | Gamberg et al. | 264/57 |
| 4,669,978 | 6/1987 | Klefisch | 432/261 |
| 4,928,939 | 5/1990 | Bell et al. | 269/309 |
| 4,978,109 | 12/1990 | Vigouroux | 432/261 |
| 5,031,886 | 7/1991 | Sosebee | 269/43 |

*Primary Examiner*—Henry A. Bennett
*Assistant Examiner*—Jiping Lu

[57] ABSTRACT

A tray for heat treatment furnace including a tray base which comprises a plate and a lattice part being fixed on the plate, said lattice part having a plurality of cylindrical reinforcements formed at cross portions thereof; a fixing device having a plurality of paired barrels being connected to each other by a plurality of connecting members, each of said paired barrels being provided with a plurality of cutting grooves on an upper surface thereof, one of the connecting members having a pair of coupling jaws for engagement with a portion of the lattice part; a plurality of spacers each being engageable with one of a respective said plurality of cutting grooves.

3 Claims, 5 Drawing Sheets

TRAY FOR HEAT TREATMENT FURNACE

BACKGROUND

The present invention relates to a tray of a heat treatment furnace and, more particularly, to a tray of a heat treatment furnace which can evenly distribute heat in the furnace, thereby reducing heating loss and producing a product of good quality.

Generally, since gears used in a vehicle transmission frequently undergo engage/disengage operations, rigidity hardening should be increased on the surfaces thereof. A well-known way to harden the surfaces of the gears is by carbonizing or naturalizing the surfaces. Also, a well-known way to harden the surfaces is through heat treating, which goes through a series of processes, including quenching, normalizing, tempering, and annealing steps.

Particularly, when heat treating, a plurality of objects to be heat-treated are loaded on a tray within a furnace. When heat is applied to a furnace by a heating device, the objects are heated at a temperature sufficient for the quenching, normalizing, tempering, and annealing steps.

As shown in FIG. 1, a conventional tray comprises a plate 60 and a continuous lattice part 62, on which a plurality of objects 64 which are to be heat-treated, are fixed on the plate.

However, the tray is designed such that the objects comes to be disorderly disposed, resulting in deterioration of heat distribution and heat loss. This increases the manufacturing cost and makes it difficult to obtain the production of products having equal quality.

SUMMARY

Therefore, the present invention is made in an effort to solve the above described problems of the conventional art.

It is an object of the present invention to provide a tray of a heat treatment furnace which can evenly distribute heat in the furnace, thereby reducing heating loss and producing a product of good quality.

To achieve the object, the present invention provides a tray for a heat treatment furnace, comprising: a tray base which comprises a plate and a lattice part being fixed on the plate, the lattice part having a plurality of cylindrical reinforcements formed at cross portions thereof, a fixing device having a plurality of paired barrels being connected to each other by a plurality of connecting members, each of the paired barrels being provided with a plurality of cutting grooves on an upper surface thereof, one of the connecting members having a pair of coupling jaws for engagement with a portion of the lattice part; a plurality of spacers each being engageable with one of a respective plurality of cutting grooves.

According to another feature of the present invention, each spacer includes a disk-shaped base plate, a plurality of L-shaped supporting frames perpendicularly and radially fixed to the upper surface of the base plate, a male connector being supported by the supporting frames at a center portion thereof, and a female connector being positioned under the male connector and being supported by the supporting frames.

According to still another feature of the present invention, the supporting frame is provided with a protrusion at a lower portion thereof, the protrusion being inserted into the cutting groove of the fixing device, and a projecting jaw, being located at an edge part above the base plate.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DESCRIPTION

A preferred embodiment of the present invention will now be described in detail with reference to the accompanying drawings.

Figure 1:
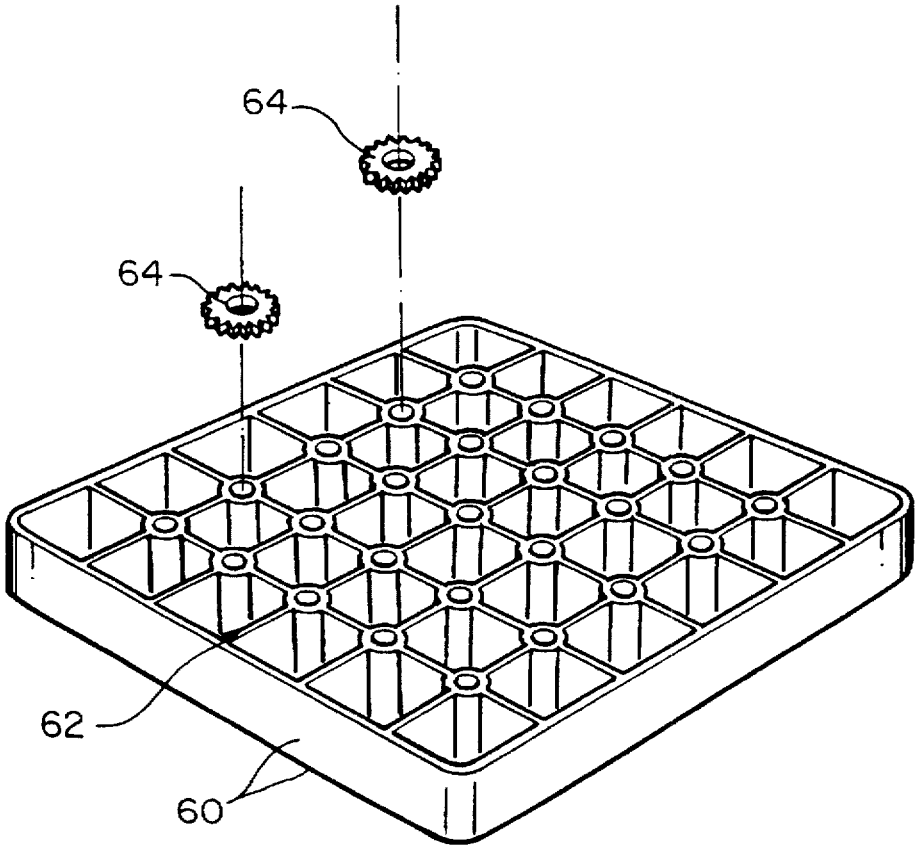
FIG. 1 PRIOR ART
FIG. 1 is a perspective view illustrating a tray of a conventional heat treatment furnace.
Figure 2:
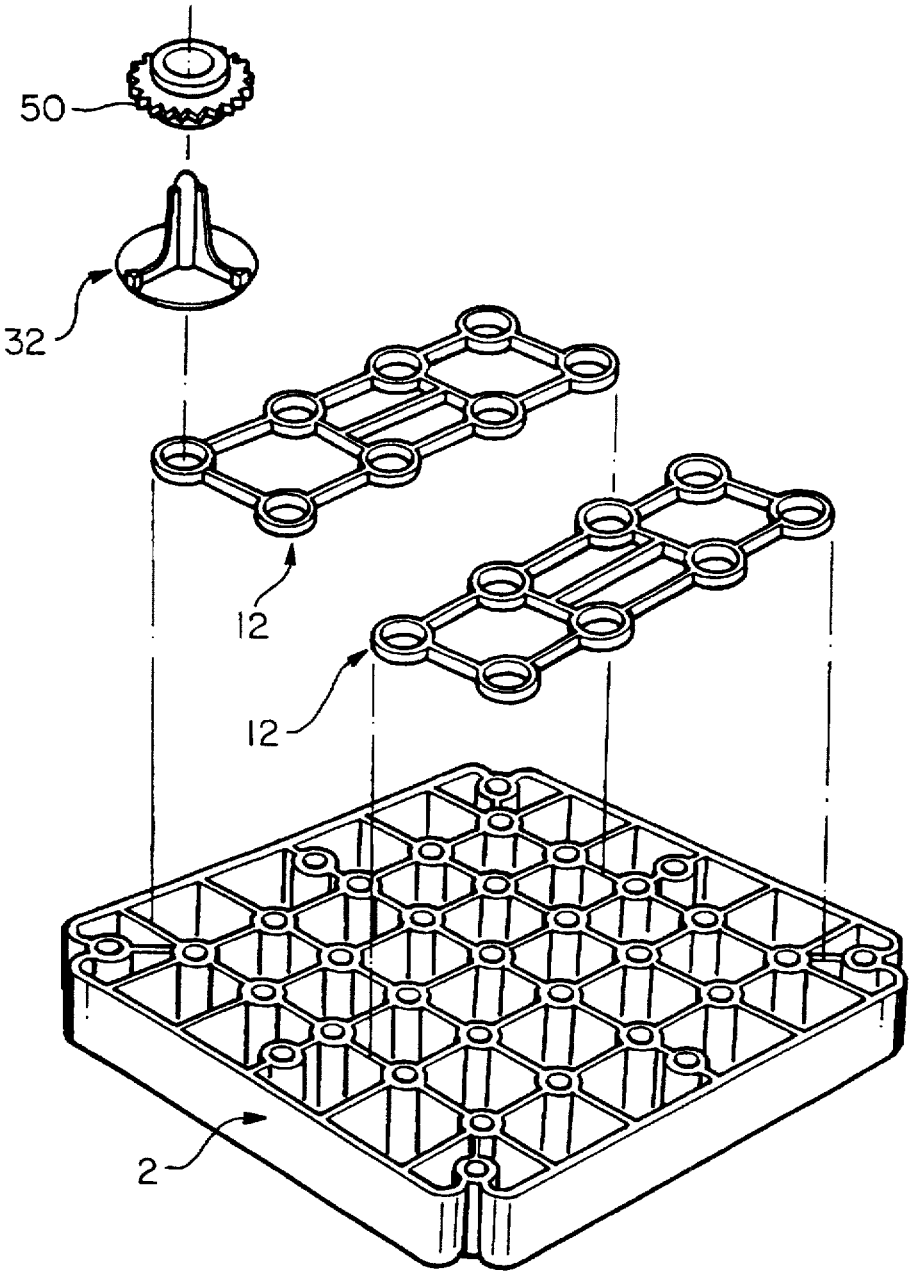
FIG. 2 is an exploded perspective view illustrating a tray of a heat treatment furnace in accordance with a preferred embodiment of the present invention.

Referring first FIG. 2, the inventive tray comprises a latticed tray base 2 and a fixing device 12 is fixedly located on the tray base 2.

Figure 3:
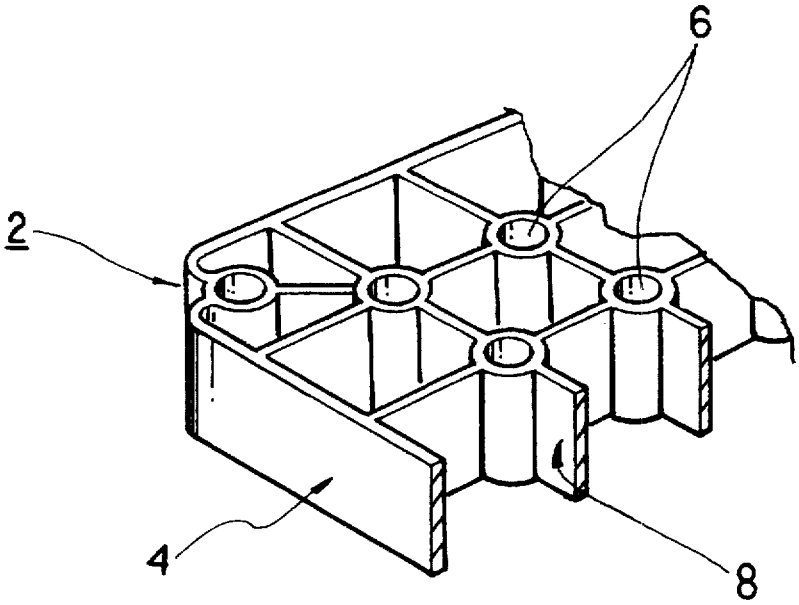
FIG. 3 is a partial perspective view illustrating a tray base of a tray in accordance with a preferred embodiment of the present invention.

The tray base 2, as shown in FIG. 3, comprises a plate 4 and a lattice part 8, which is fixed on the plate 4, having a cylindrical reinforcement 6 formed on each cross portions of the lattice part 8.

Figure 4:
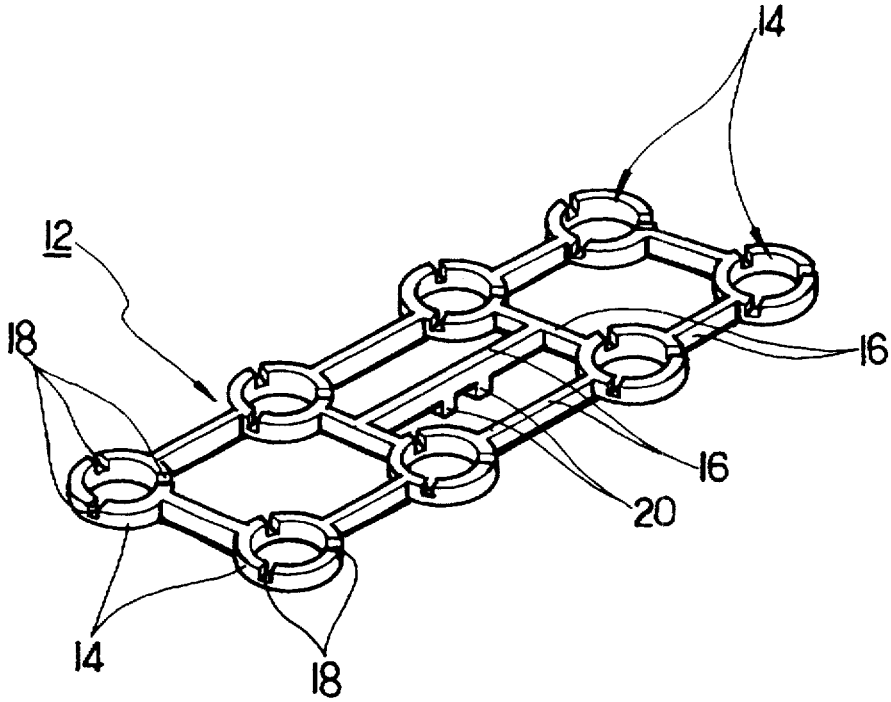
FIG. 4 is a partial perspective view illustrating a fixing device of a tray in accordance with a preferred embodiment of the present invention.

The fixing device 12, as shown in FIG. 4, has a plurality of paired barrels 14, which are disposed at an equal distance. The paired barrels are connected to each other by a plurality of connecting members 16. Each barrel 14 is provided with a plurality of cutting grooves 18 on its upper surface. A pair of coupling jaws 20, where a portion of the lattice part 8 is inserted, are formed on one of the connecting members 16.

Figure 5:
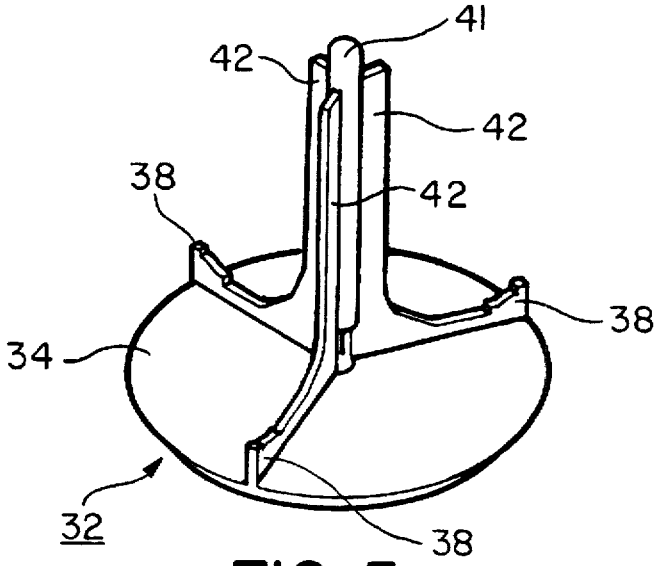
FIGS. 5 and 6 are perspective views illustrating a spacer in accordance with a preferred embodiment of the present invention.
Figure 6:
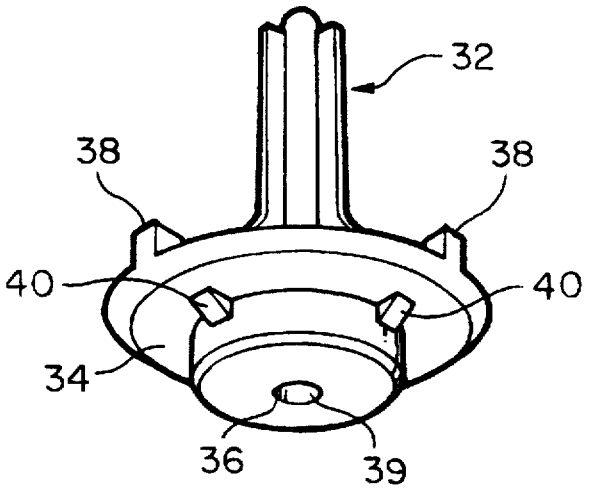
Figure 7:
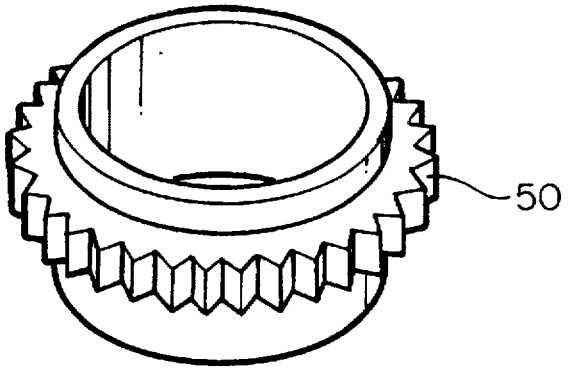
FIG. 7 is a perspective view illustrating an example of an object which is to be heat-treated by a heat treatment furnace in accordance with a preferred embodiment of the present invention.

In addition, the tray further comprises a plurality of spacers 32 on which a plurality of objects depicted, as an example to be heat-treated in FIG. 7 are seated at a predetermined distance, and are fixed at their lower portion on the barrels 18 of the fixing device 12 (see FIG. 2). That is, as shown in FIGS. 5 and 6, the spacer 32 comprises a hollow disk-shaped base plate 34, a female connector 36 extending from the under surface of the base plate 34, and a recess 39 defined on the central portion of the female connector 36.

The spacer 32 further comprises a plurality of protrusions 40, which are formed on an outer circumference of the female connector 36 at an equal distance and inserted into the cutting groove 18, respectively, a plurality of projecting jaws 38 extending from the edge of the upper surface of the base plate 34 to prevent the position displacement of the objects 50, and a male connector 41, which is formed on the central portion of the base plate 34 and is inserted into a central portion of the object 50. The male connector 41 is supported by a plurality of L-shaped supporting frames extending to the projecting jaws 38. These supporting frames 42 reinforce the male connector 41 and the base plate 34 so as to prevent both the male connector 41 and the base plate 34 from being easily deformed.

Figure 8:
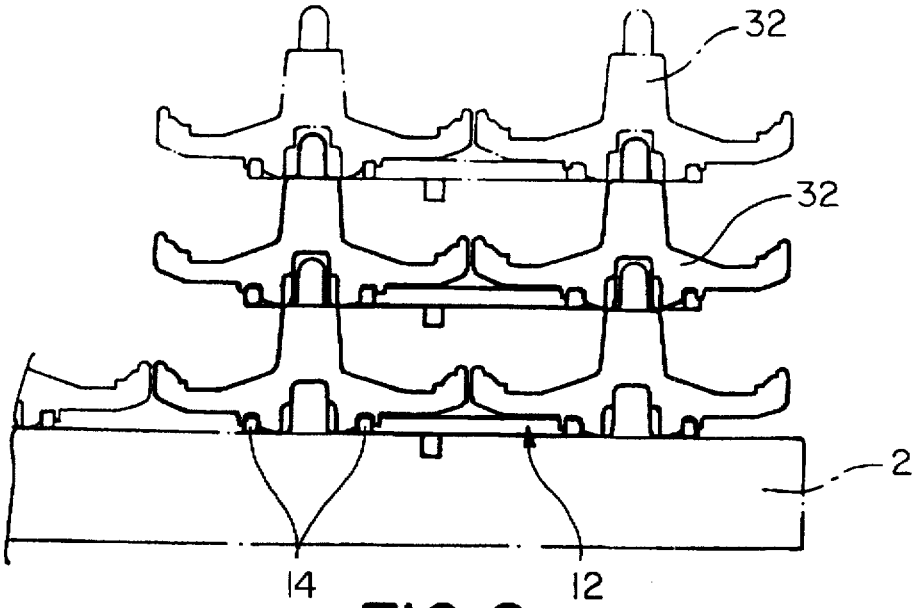
FIG. 8 is a sectional view illustrating a tray for a heat treatment furnace in accordance with a preferred embodiment of the present invention.

In the tray as described above and as shown in FIG. 8, the fixing device 12 is fixedly located on the upper surface of the tray base 2 by fixing the coupling jaws 20 on a portion of the lattice part 8. The spacers 32, on each of which the objects 50 are seated, are disposed such that the protrusions 40 can be inserted into the cutting grooves 18 formed on each barrel 14 of the fixing device 12. Accordingly, when the tray as described above is disposed within the furnace and the objects are heated with a temperature required for heat treatment such as quenching, normalizing, tempering, and annealing, the heat applied to the furnace, is evenly distributed between the objects and the spacers, thereby heating the objects evenly.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A tray for a heat treatment furnace, comprising:

a tray base which comprises a plate and a lattice part being fixed on the plate, said lattice part having a plurality of cylindrical reinforcements formed at cross portions thereof;

a fixing device having a plurality of paired barrels being connected to each other by a plurality of connecting members, each of said paired barrels being provided with a plurality of cutting grooves on an upper surface thereof, one of the connecting members having a pair of coupling jaws extending from a bottom surface thereof for engagement with a portion of the lattice part;

a plurality of spacers each being engageable with one of a respective said plurality of cutting grooves.

2. A tray for a heat treatment furnace according to claim 1, wherein each spacer includes a disk-shaped base plate having a recess therein, a plurality of L-shaped supporting frames perpendicularly and radially fixed to the upper surface of the disk-shaped base plate, a male connector being supported by the supporting frames at a center portion thereof, and a female connector being positioned under the male connector and being supported by the supporting frames.

3. A tray for a heat treatment furnace according to claim 2, wherein the supporting frame is provided with a protrusion at a lower portion thereof, the protrusion being inserted into the cutting groove of the fixing device, and a projecting jaw being located at an angle part above the base plate.

* * * * *